United States Patent [19]

Mitchell et al.

[11] Patent Number: 4,698,849

[45] Date of Patent: Oct. 13, 1987

[54] FOOTBALL JERSEY

[75] Inventors: Hal D. Mitchell, Rolla, Mo.; James D. Gardner, Knoxville, Tenn.

[73] Assignee: Figgie International Inc., Willoughby, Ohio

[21] Appl. No.: 6,168

[22] Filed: Jan. 23, 1987

[51] Int. Cl.[4] ..... A41B 1/00

[52] U.S. Cl. ..... 2/115

[58] Field of Search ..... 2/115, 70, 71, 243, 2/103

[56] References Cited

U.S. PATENT DOCUMENTS

| | | | |
|---|---|---|---|
| 243,498 | 6/1881 | Brown . | |
| 378,465 | 2/1888 | Scriven . | |
| 1,714,491 | 5/1929 | Burr . | |
| 1,973,419 | 9/1934 | Trageser | 2/93 |
| 2,312,777 | 3/1943 | Sholder et al. | 2/125 |
| 2,314,226 | 3/1943 | Lee | 2/94 |
| 2,343,103 | 2/1944 | White | 2/115 |
| 2,613,360 | 10/1952 | Friedland et al. | 2/90 |
| 2,836,826 | 6/1958 | Geiss | 2/125 |
| 2,839,756 | 6/1958 | Geiss | 2/125 |
| 2,941,210 | 6/1960 | Bren | 2/115 |
| 2,986,740 | 6/1961 | Schudson | 2/115 |
| 3,013,276 | 12/1961 | Maxwell | 2/115 |
| 3,037,210 | 6/1962 | Neuman | 2/125 |
| 3,078,699 | 2/1963 | Humtley | 2/115 |
| 3,137,860 | 6/1964 | Bindler | 2/115 |
| 4,249,268 | 2/1981 | Berler | 2/115 |

*Primary Examiner*—Doris L. Troutman

*Attorney, Agent, or Firm*—Senniger, Powers, Leavitt and Roedel

[57] ABSTRACT

A jersey for football players and the like. The jersey comprises a body section. The body section includes a shoulder portion having a substantially inverted U-shape as viewed from the side such that it is adapted to overlay the shoulders of a wearer or a shoulder pad on the shoulders of the wearer, a chest portion adapted to cover the chest of the wearer, and a back portion adapted to cover the back of the wearer. The shoulder, chest and back portions are of relatively inelastic material. The body section also includes elastic lateral gussets for laterally tensioning the chest and back portions over the chest and back, respectively, of a wearer so that the chest and back portions fit relatively tightly around the chest and back of the wearer thereby to inhibit opposing players from getting a hand hold on the jersey. The jersey also includes arm portions adapted to cover the arms of the wearer. The arm portions are of relatively inelastic material. Elastic arm gussets are provided for tensioning the arm portions circumferentially over the arms of the wearer so that the arm portions fit relatively tightly around the arms of the wearer thereby to inhibit hand holds by opposing players. Elastic shoulder gussets are provided adjacent the arm portions, the gussets allowing more stretch than the body section so that the arms may be repeatedly raised and lowered without pulling the body of the jersey upward thereby allowing a jersey which is tucked into the pants of a wearer to remain tucked into the pants.

18 Claims, 2 Drawing Figures

FOOTBALL JERSEY

BACKGROUND OF THE INVENTION

This invention relates generally to jerseys, and more particularly to a football jersey which is adapted to stay tucked into the pants of a wearer.

Football jerseys have commonly come untucked from the pants of a wearer while the wearer is running and/or moving his or her arms while blocking, catching or throwing a football. Opposing players have taken advantage of this to grab the tail of the jersey when attempting to tackle the wearer. Often the jersey becomes untucked when the wearer is raising his or her arms, which pulls the jersey upwardly from the pants. Since conventional jerseys are cut with the sleeve at an angle of approximately 30 degrees downwardly from vertical, there is considerable tension in the body of the jersey pulling the jersey upwardly when the wearer raises his or her arms. In addition, tackling is made easier if the jersey is loose fitting or becomes loose fitting while the player is moving, since any loose or hanging material presents an easy target to be grabbed by opposing players. Moreover, sleeves, as well as the body of the jersey, may present such a target if they are loose fitting.

Heretofore, football jerseys have been designed to be relatively loose fitting to allow the arms and body to move freely without undue resistence from the jersey. A tight-fitting jersey will not be acceptable if it reduces the mobility of the wearer such that it becomes easy to tackle the wearer or difficult to pass, catch and block.

One approach to this problem may be to make a jersey from elastic (stretchable) material so the it is more likely to remain tight-fitting when the wearer is moving. Numbering and lettering, however, are likely to become distorted, making it difficult for fans to determine the identity of the wearer, when the wearer moves if they are attached to stretchable material. In addition, stretchable material has a limit to how far it may be stretched without tearing or reducing the mobility of the player. This limit may be exceeded when the player raises his or her arms to catch or pass the football.

SUMMARY OF THE INVENTION

Among the several objects of this invention may be noted the provision of a jersey, particularly adapted for football players and the like, that is tight-fitting to inhibit hand holds by opposing players; the provision of such a jersey which remains tucked into the pants of the wearer even when the arms of the wearer are repeatedly moved up and down; the provision of such a jersey which preloads a shoulder pad on the shoulders of the wearer when the arms of the wearer are lowered; the provision of such a jersey pad which provides the wearer, particularly the arms of the wearer, with maximum freedom of movement; the provision of such a jersey which includes portions for numbering or letters, the portions being adapted to inhibit distortion of the numbers and letters; and the provision of such a jersey which is inexpensive and durable.

Generally, a jersey of the present invention is designed for football players and the like, and includes a body section. The body section further includes a shoulder portion having a substantially inverted U-shape as viewed from the side such that it is adapted to overlay the shoulders of a wearer or a shoulder pad on the shoulders of the wearer, a chest portion adapted to cover the chest of the wearer, and a back portion adapted to cover the back of the wearer. The shoulder, chest and back portions are of relatively inelastic material. The body section also includes means for laterally tensioning the chest and back portions over the chest and back, respectively, of a wearer so that the chest and back portions fit relatively tightly around the chest and back of the wearer thereby to inhibit opposing players from getting a hand hold on the jersey. The jersey also includes arm portions adapted to cover the arms of the wearer. The arm portions are of relatively inelastic material. Means for tensioning the arm portions circumferentially over the arms of the wearer is provided so that the arm portions fit relatively tightly around the arms of the wearer thereby to inhibit hand holds by opposing players. Stretch means adjacent the arm portions allowing more stretch than the body section is provided so that the arms may be repeatedly raised and lowered without pulling the body of the jersey upward thereby allowing a jersey which is tucked into the pants of a wearer to remain tucked into the pants.

A second aspect of this invention is a jersey for use with a shoulder pad, such as a football shoulder pad. The shoulder pad has left and right arch portions, and the arch portions have a generally inverted U-shape when viewed from the side to adapt the shoulder pad to be worn over the shoulders of a wearer. The jersey comprises a body section, which includes a shoulder portion having a substantially inverted U-shape as viewed from the side to adapt the shoulder portion to overlay the arch portions of the shoulder pad, a chest portion adapted to cover the chest of the wearer, and a back portion adapted to cover the back of the wearer. The shoulder, chest and back portions are of relatively inelastic material. Means is provided for laterally tensioning the chest and back portions over the chest and back, respectively, of a wearer so that the chest and back portions fit relatively tightly around the chest and back of the wearer to inhibit opposing players from getting a hand hold on the jersey. The jersey also includes arm portions of relatively inelastic material adapted to cover the arms of the wearer. Means is provided for tensioning the arm portions circumferentially over the arms of the wearer so that the arm portions fit relatively tightly around the arms of the wearer to inhibit hand holds by opposing players. Stretch means is provided adjacent the arm portions allowing more stretch than the body section so that the arms may be repeatedly raised and lowered without pulling the body of the jersey upward thereby allowing a jersey which is tucked into the pants of a wearer to remain tucked into the pants.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
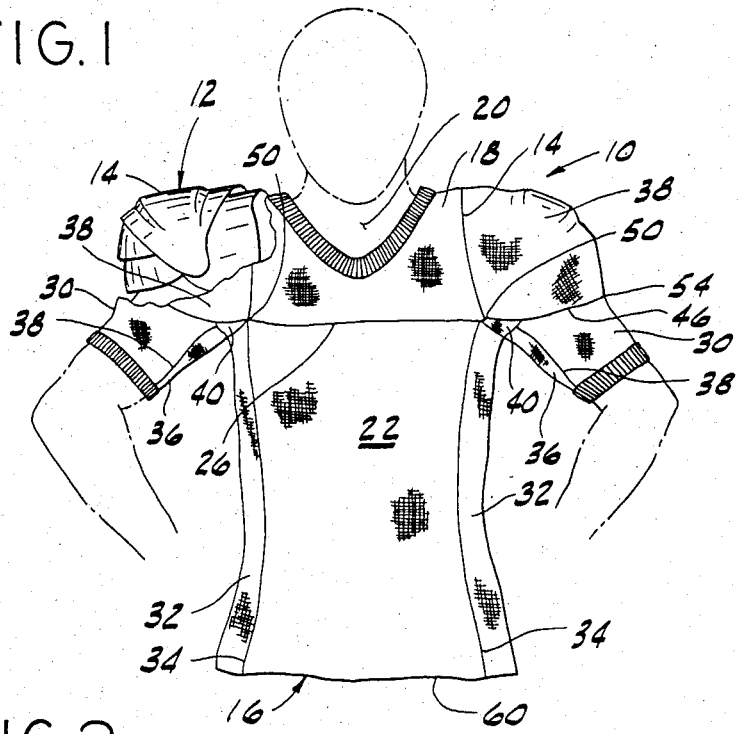
FIG. 1 is a front elevation of a jersey of the present invention, illustrating the jersey as worn when the arms of the wearer, shown in phantom, are lowered.

Now referring to the drawings, a jersey of the present invention is designated in its entirety by the reference numeral 10. As shown in FIG. 1, jersey 10 is especially designed for football players to be worn over a football shoulder pad generally designated 12. The shoulder pad 12 has left and right arch portions, only the right one designated 14 being shown. The arch portions have a generally inverted U-shape-when viewed from the side so that the shoulder pad may be worn over the shoulders of a wearer.

The jersey 10 comprises a body section generally designated 16, which includes a shoulder portion or portions 18 having a neck opening 20, a chest portion (panel) 22 adapted to cover the chest of the wearer and a back portion (panel) 24 adapted to cover the back of the wearer. The shoulder, chest and back portions 18, 22 and 24, respectively, are of relatively inelastic material, and may be of one unitary piece of material or of separate pieces of material stitched together along seams 26 and 28, respectively, as shown in the drawings. The shoulder portion 18 preferably has a substantially inverted U-shape as viewed from the side such that it is adapted to overlay the arch portions of the shoulder pad 12 or the shoulders of the wearer. The jersey 10 also includes arm portions 30 adapted to cover the arms of the wearer, the arm portions also being of relatively inelastic material.

Preferably, means is provided for laterally tensioning the chest and back portions, 22 and 24, respectively, over the chest and back, respectively, of a wearer so that the chest and back portions fit relatively tightly around the chest and back of the wearer to inhibit opposing players from getting a hand hold on the jersey 10. For example, the tensioning means for laterally tensioning the chest and back portions may include side gussets 32 of relatively elastic material (e.g., spandex) connecting (at stitched seams 34) the back and chest portions, 22 and 20, respectively, of the jersey. The jersey 10 is sized to fit tightly around the body of the wearer with the side gussets 32 stretched (tensioned) somewhat to maintain the tight fit around the body when it is moving, stretching, etc. Each side gusset 32 is sufficiently stretchable to permit free body movement of the wearer.

In addition, means is provided for tensioning the arm portions 30 circumferentially (i.e., laterally and/or peripherally) over the arms of the wearer so that the arm portions fit relatively tightly around the arms of the wearer, thereby to inhibit hand holds by opposing players. For example, the means for circumferentially tensioning the arm portions may include a strip or gusset 36 of relatively elastic material (e.g., spandex) connected by stitching 38 or the like longitudinally along each arm portion 30. The arm portions 30 and gussets 36 are sized to fit tightly around the arms of the wearer with each gusset stretched (tensioned) somewhat so that when the arms are moved the tight fit is maintained. Each gusset 36 is sufficiently stretchable to allow the arms to move freely.

Stretch means is provided adjacent the arm portions 30, the stretch means allowing more stretch than the body section 16 so that the arms may be repeatedly raised and lowered without pulling the body of the jersey upward, thereby allowing a jersey which is tucked into the pants (not shown) of a wearer to remain tucked into the pants. Preferably, the stretch means is adapted for tensioning the shoulder portion 18 over the shoulder pad 12 (or the shoulders of a wearer) when the arms of the wearer are lowered such that the shoulder portion is adapted to preload the shoulder pad, thereby to improve the load bearing function of the shoulder pad.

For example, stretch means may include elastic shoulder gussets 38 adapted to cover the lateral edges of the shoulder pad 12 (or the shoulders of the wearer and the upper portion of the arms of the wearer), and elastic stretch gussets 40 adapted to cover the armpits of the wearer. Each stretch gusset 40 connects the respective arm portion 30 to the respective side of the chest and back portions 22 and 24, respectively. The shoulder gussets 38 connect the arm portions 30 to the shoulder portion 18 by, for example, stitching along the edges 44, 46 and 48 of the gusset.

Figure 2:
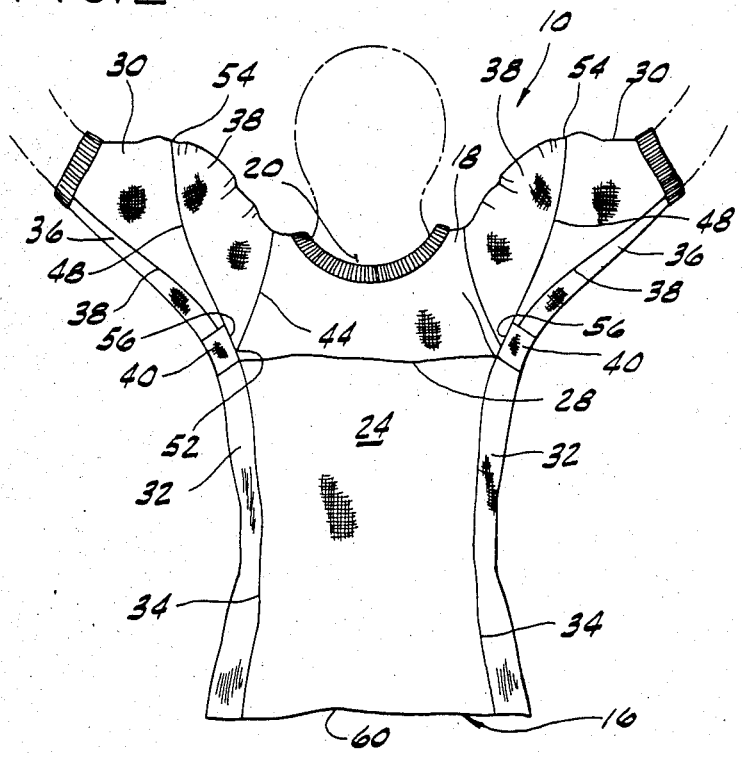
FIG. 2 is a rear elevation of the jersey and football player of FIG. 1, illustrating various features of the jersey when the arms of the wearer are raised.

Preferably, each shoulder gusset 38 has a generally triangular configuration when relaxed, as shown in FIG. 2. The triangular gusset 38 has a base side (edge 44) adjacent the shoulder portion 18 with ends points 50 and 52 adjacent the chest and back portions, respectively. The other sides (edges 46 and 48) have their common end point 54 adjacent the arm portion 30, the common end point being adapted to cover the lateral upper edge of the respective arm of the wearer.

Each stretch gusset 40 preferably has a generally rectangular configuration, the rectangle having short sides 56 adjacent the respective shoulder gusset 18 which are stitched to the shoulder gusset. The stretch gussets are stitched along their long sides to the arm portions 30 and side gussets 32.

Preferably, the stretch means (e.g., shoulder and stretch gussets 38 and 40, respectively) is adapted to be relaxed when the central longitudinal axis of the arm portions are at an angle approximately of 20 degrees above horizontal (i.e., 110 degrees upwardly from the central longitudinal axis of the body section). This arm portion/body section angle, in conjunction with the elastic properties of the shoulder and stretch gussets, allows the arms of the wearer to move freely up and down without pulling the lower edge 60 of the body section 16 out of the pants (not shown). As shown in FIG. 2, the shoulder and stretch gussets 38 and 40, respectively, are relaxed when the wearer's arms are raised upwardly ("the action position"), thereby improving the wearer's mobility when it is most needed (e.g., to pass or catch a football).

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A jersey for football players and the like comprising a body section, the body section including a shoulder portion having a substantially inverted U-shape as viewed from the side such that it is adapted to overlay the shoulders of a wearer or shoulder pad on the shoulders of the wearer, a chest portion adapted to cover the chest of the wearer, a back portion adapted to cover the back of the wearer, the shoulder, chest and back portions being of relatively inelastic material, and means for laterally tensioning the chest and back portions over the chest and back, respectively, of a wearer so that the chest and back portions fit relatively tightly around the chest and back of the wearer thereby to inhibit opposing players from getting a hand hold on the jersey, the jersey also including arm portions adapted to cover the arms of the wearer, the arm portions being of relatively inelastic material, means for tensioning the arm portions circumferentially over the arms of the wearer so that the arm portions fit relatively tightly around the arms of the wearer thereby to inhibit hand holds by opposing players, and stretch means adjacent the arm portions allowing more stretch than the body section so that the arms may be repeatedly raised and lowered without pulling the body of the jersey upward thereby allowing a jersey which is tucked into the pants of a wearer to remain tucked into the pants.

2. A jersey as set forth in claim 1 wherein the tensioning means for laterally tensioning the chest and back portions includes side gussets connecting the back and chest portions of the jersey, the side gussets being of relatively elastic material, the means for circumferentially tensioning the arm portions including a longitudinal strip or gusset of relatively elastic material along each arm portion.

3. A jersey as set forth in claim 2 wherein the stretch means for allowing the arms to freely move up and down includes shoulder and/or stretch gussets of elastic material, the shoulder and/or stretch gussets connecting the arm portions of the jersey to the body section of the jersey, the shoulder and/or stretch gussets being adapted to cover the lateral edge portions of the shoulders of a wearer, the upper portion of the arms of the wearer and the armpit of the wearer.

4. A jersey as set forth in claim 1 wherein the means for allowing the arms to move freely up or down without unduly stretching the body section includes elastic shoulder gussets and elastic stretch gussets, each shoulder gusset being adapted to cover the respective lateral edge of the shoulders of the wearer, each stretch gusset being adapted to cover the respective armpit of the wearer, each stretch gusset connecting the respective arm portion to the respective side of the chest and back portions.

5. A jersey as set forth in claim 4 wherein each shoulder gusset has a generally triangular configuration, the triangle having a base side adjacent the shoulder portion with end points adjacent the chest and back portions, the other sides having their common end point adjacent the arm portion, the common end point being adapted to cover the lateral upper edge of the respective arm of the wearer.

6. A jersey as set forth in claim 4 wherein each stretch gusset has a generally rectangular configuration, the rectangle having short sides adjacent the respective shoulder gusset.

7. A jersey as set forth in claim 1 wherein the stretch means are adapted for tensioning the shoulder portion over the shoulders of a wearer when the arms of the wearer are lowered such that the shoulder portion is adapted to preload a shoulder pad on the shoulders of the wearer thereby to improve the load bearing function of the shoulder pad.

8. A jersey as set forth in claim 7 wherein the stretch means includes triangular shoulder gussets of elastic material, each shoulder gusset being adapted to overlay the lateral edge of the respective shoulder or shoulder pad, each triangular shoulder gusset connecting the respective arm portion to the respective shoulder portion.

9. A jersey as set forth in claim 1 wherein the stretch means are adapted to be relaxed when the central longitudinal axes of the arm portions are at an angle of approximately 110 degrees upwardly with respect to the central longitudinal axis of the body section.

10. A jersey for use with a shoulder pad, such as a football shoulder pad, having left and right arch portions, the arch portions having a generally inverted U-shape when viewed from the side thereby adapting the shoulder pad to be worn over the shoulders of a wearer, the jersey comprising a body section, the body section including a shoulder portion having a substantially inverted U-shape as viewed from the side to adapt the shoulder portion to overlay the arch portions of the shoulder pad, a chest portion adapted to cover the chest of the wearer, a back portion adapted to cover the back of the wearer, the shoulder, chest and back portions being of relatively inelastic material, and means for laterally tensioning the chest and back portions over the chest and back, respectively, of a wearer so that the chest and back portions fit relatively tightly around the chest and back of the wearer thereby to inhibit opposing players from getting a hand hold on the jersey, the jersey also including arm portions adapted to cover the arms of the wearer, the arm portions being of relatively inelastic material, means for tensioning the arm portions circumferentially over the arms of the wearer so that the arm portions fit relatively tightly around the arms of the wearer thereby, to inhibit hand holds by opposing players, and stretch means adjacent the arm portions allowing more stretch than the body section so that the arms may be repeatedly raised and lowered without pulling the body of the jersey upward thereby allowing a jersey which is tucked into the pants of a wearer to remain tucked into the pants.

11. A jersey as set forth in claim 10 wherein the tensioning means for laterally tensioning the chest and back portions includes side gussets connecting the back and chest portions of the jersey, the side gussets being of relatively elastic material, the means for circumferentially tensioning the arm portions including a longitudinal strip or gusset of relatively elastic material along each arm portion.

12. A jersey as set forth in claim 11 wherein the stretch means for allowing the arms to freely move up and down includes shoulder and/or stretch gussets of elastic material, the shoulder and/or stretch gussets connecting the arm portions of the jersey to the body section of the jersey, the shoulder and/or stretch gussets being adapted to cover the lateral upper edge of the shoulder pad, the upper portion of the arms of the wearer and the armpit of the wearer.

13. A jersey as set forth in claim 10 wherein the means for allowing the arms to move freely up or down without unduly stretching the body section includes elastic shoulder gussets and elastic stretch gussets, each shoulder gusset being adapted to cover the respective lateral edge of the shoulder pad, each stretch gusset being adapted to cover the respective armpit of the wearer, each stretch gusset connecting the respective arm portion to the respective side of the chest and back portions.

14. A jersey as set forth in claim 13 wherein each shoulder gusset has a generally triangular configuration, the triangle having a base side adjacent the shoulder portion with end points adjacent the chest and back portions, the other sides having their common end point adjacent the arm portion, the common end point being adapted to cover the lateral upper edge of the respective arm of the wearer.

15. A jersey as set forth in claim 13 wherein each stretch gusset has a generally rectangular configuration, the rectangle having short sides adjacent the respective shoulder gusset.

16. A jersey as set forth in claim 10 wherein the stretch means are adapted for tensioning the shoulder portion over the shoulder pad when the arms of the wearer are lowered such that the shoulder portion is adapted to preload the shoulder pad thereby to improve the load bearing function of the shoulder pad.

17. A jersey as set forth in claim 16 wherein the stretch means includes triangular shoulder gussets of elastic material, each shoulder gusset being adapted to overlay the lateral edge of the respective shoulder pad, each triangular shoulder gusset connecting the respective arm portion to the respective shoulder portion.

18. A jersey as set forth in claim 15 wherein the stretch means are adapted to be relaxed when the central longitudinal axes of the arm portions are at an angle of approximately 110 degrees upwardly with respect to the central longitudinal axis of the body section.

* * * * *